United States Patent [19]

Merker

[11] Patent Number: 4,672,832

[45] Date of Patent: Jun. 16, 1987

[54] METHOD AND APPARATUS FOR TUBE EXPANSION

[75] Inventor: David E. Merker, Minerva, Ohio

[73] Assignee: The Babcock & Wilcox Company, New Orleans, La.

[21] Appl. No.: 755,973

[22] Filed: Jul. 17, 1985

Related U.S. Application Data

[63] Continuation of Ser. No. 512,276, Jul. 11, 1983, abandoned.

[51] Int. Cl.[4] ..... B21D 39/20

[52] U.S. Cl. ..... 72/62; 72/63; 72/706; 72/54

[58] Field of Search ..... 29/421 E; 72/56, 63, 72/62, 706, 61, 54

[56] References Cited

U.S. PATENT DOCUMENTS

| | | | |
|---|---|---|---|
| 3,206,845 | 9/1965 | Crump | 29/421 E |
| 3,220,103 | 11/1965 | Simons | 29/421 E |
| 3,222,902 | 12/1965 | Brejcha | 72/63 |
| 3,397,563 | 8/1968 | Pelton | 72/63 |
| 3,593,551 | 7/1971 | Roth | 72/63 |
| 3,631,699 | 1/1972 | Roth | 72/63 |
| 3,661,004 | 5/1972 | Lee | 72/56 |
| 3,688,535 | 9/1972 | Keinanen | 72/63 |
| 3,751,954 | 8/1973 | Ezra et al. | 29/421 E |
| 3,863,327 | 2/1975 | Legate | 72/56 |
| 4,120,439 | 10/1978 | Persson | 29/421 E |

OTHER PUBLICATIONS

"Steam/Its Generation and Use", Babcock & Wilcox, 1972, pp. 23-9-23-11.

"Standard Handbook for Mechanical Engineers", Baumeister, editor, 7th ed. 1967, pp. 9-52 and 9-53.

*Primary Examiner*—Robert L. Spruill
*Assistant Examiner*—David B. Jones
*Attorney, Agent, or Firm*—Robert J. Edwards

[57] ABSTRACT

An apparatus and method for radially expanding a tubular member and comprising first and second spaced apart end caps rigidly connected to each other by a post. An expandable bladder fixed to each end cap and extending around the post to define an annular space. A propellant disposed in the annular space and ignition apparatus associated with the propellant. The propellant being of the type which burns rapidly to generate large amounts of gas for expanding the bladder. The tubular member being disposed around the bladder for radial expansion.

11 Claims, 3 Drawing Figures

METHOD AND APPARATUS FOR TUBE EXPANSION

This application is a continuation of application Ser. No. 512,276 filed July 11, 1983, now abandoned.

FIELD AND BACKGROUND OF THE INVENTION

The present invention relates in general to the repairing, installing or otherwise manipulating of tubular members, and in particular to a new and useful apparatus and method for radially expanding tubes.

When installing or repairing tubes, it is often advantageous to manipulate and shape the tubes or tubular members from within the tubes.

In nuclear-fueled vapor generators, a repair process is known whereby a tubular member is placed inside a steam generator tube and expanded near its end. A brazed joint is then made to sealably fix the tubular member within the steam generator tube. The previous method for accomplishing this was to use a hydraulic expander to expand the tubular member in the joint area prior to brazing. This process proved to be too slow and cumbersome thereby limiting the number of tubes which could be repaired in a given period of time. This was especially disadvantageous with regard to nuclear steam generators since the longer repair time resulted in an increase in nuclear radiation exposure for pesonnel making the repairs.

A method and apparatus for hydraulically expanding tubing is known from U.S. Pat. No. 4,195,390 to Amen. An expandable bladder is mounted between the caps connected to each other by a tie rod situated within the bladder. Hydraulic pressure is internally supplied to the bladder to expand the bladder and a surrounding tubular member. However, as noted above, hydraulic expansion is much too slow, particularly in a nuclear radiation environment. Furthermore, external pressure sources are required which add to the time necessary in operating the Amen device.

More rapid expansion techniques are known which utilize propellant or explosive charges. U.S. Pat. No. 3,287,947 to Frantz et al, for example, discloses a tube flaring technique utilizing an explosive charge to outwardly flare the end of a tube. U.S. Pat. No. 3,876,233 to Schmedding et al discloses an automatic pipe coupling device which uses a propellant for effecting a wedging action to move two parts with respect to each other.

SUMMARY OF THE INVENTION

The present invention provides a method and apparatus for rapid expansion of tubular members. All of the set up work is done outside the immediate repair area. This is particularly useful for nuclear environments where exposure should be reduced to a minimum.

Accordingly, an object of the present invention is to provide an apparatus and method for radially expanding a tubular member and comprising a first end cap, a second end cap spaced from the first end cap, a post rigidly connecting the end caps to each other, an expandable bladder connected between the end caps and extending around the post to define a closed space, a propellant or explosive charge contained within the space and ignition means associated with the propellant for igniting the propellant and expanding the bladder outwardly.

With the bladder and its end caps positioned within the tubular member, the propellant can be ignited to radially expand the tubular member, for any desired purpose. The propellant-actuated device can thus be utilized to expand repair tubing within a vapor generator tube of a nuclear-fueled vapor generator.

The invention is also useful for expanding tubing into other elements such as tube sheets, support plates, headers and the like. The device can also be used for expanding tube plugs and producing special tube configurations.

Another object of the invention is to provide an apparatus and method for radially expanding a tube which is simple in design, rugged in construction, economical to manufacture and easy to implement.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
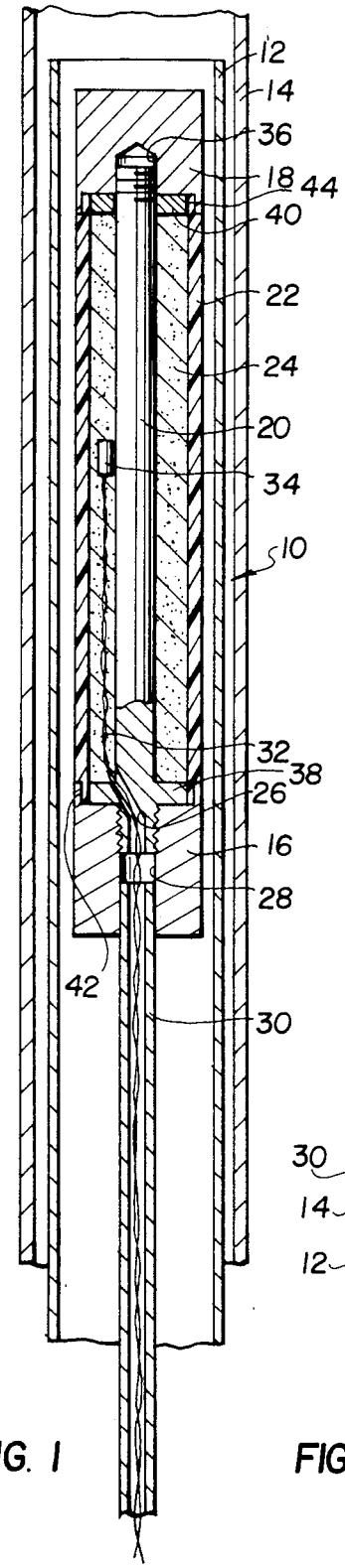
FIG. 1 is a sectional view of a propellant-actuated apparatus shown with a tubular member to be expanded within a vapor generator tube, in accordance with the invention.

Referring to the drawings in particular, the invention embodied therein comprises an apparatus generally designated 10 for radially expanding a tubular member 12 which, for example, may be repair tubing for a vapor generator tube 14 of a nuclear vapor generator (not shown).

The inventive apparatus comprises a first cap 16, a second cap 81 and a central post or tie rod 20 rigidly connected to both caps and holding them in a spaced relationship.

In the usual vertical orientation of vapor generator tube 14, the first cap 16 would form a lower cap and the second cap 18 would form an upper cap.

A flexible, resilient bladder 22 is fixedly connected between caps 16 and 18 and extends around post 20 to form a space 24 which is preferably annular. A propellant is provided in space 24 to partially or fully fill the space.

Access is had to the space through an ignition port 26 formed in one end of post 20. Port 26 communicates with bore 28 of cap 16. A positioning rod 30 may be fixed to cap 16, for example by press fitting or threading the end of rod 30 into bore 28. This facilitates the positioning of apparatus 10 in the tubular member 12 at the desired position.

Ignition means are provided in the form of an electrical wire 32 and an ignitor 34. Wire 32 may be supplied through a central bore of rod 30, the bore 28 and the port 26. Alternative known ignition means may also be provided which may or may not require mechanical access to space 24 through port 26.

The end of post 20 containing port 26 is threaded into bore 28 and the opposite end is threaded into a blind bore 36 of cap 18.

To properly support and hold bladder 22 so that it closes space 24, except for port 26, post 20 may include a flange 38 or may be surrounded by a separate ring 40 which bears against the inner surface of bladder 22 adjacent its ends. Caps 16 and 18 are provided with sleeve extensions 42 and 44 respectively to support the outer end surfaces of the bladder.

In operation, the apparatus is positioned as shown in FIG. 1.

Figure 2:
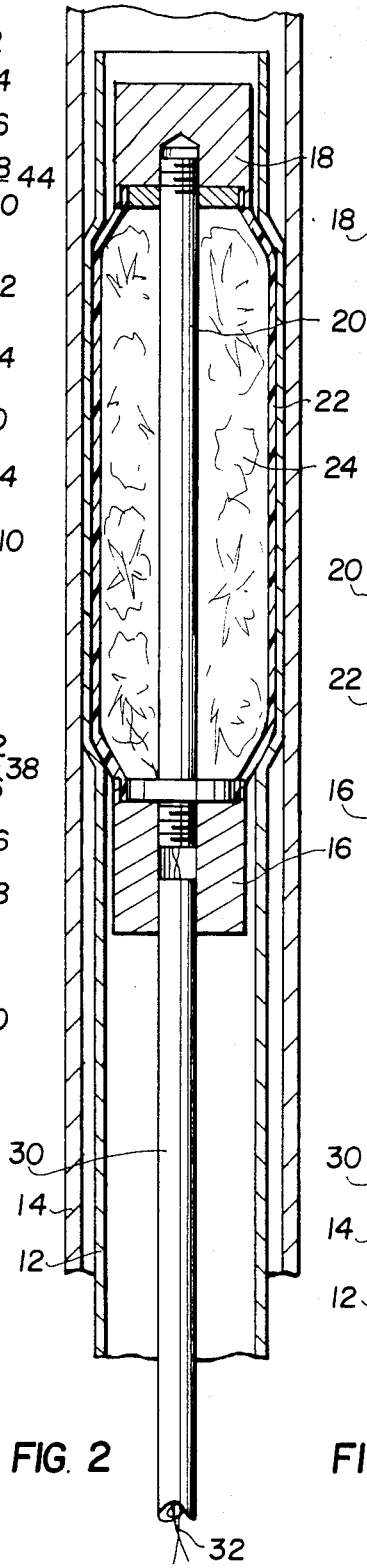
FIG. 2 is a view similar to FIG. 1 showing the apparatus an instant after the propellant has been ignited.

Upon igniting the propellant, which is preferably fast burning, voluminous amounts of gas are generated thereby creating high pressure to rapidly expand the bladder 22, and a surrounding portion of the tubular member 12 as shown in FIG. 2.

Figure 3:
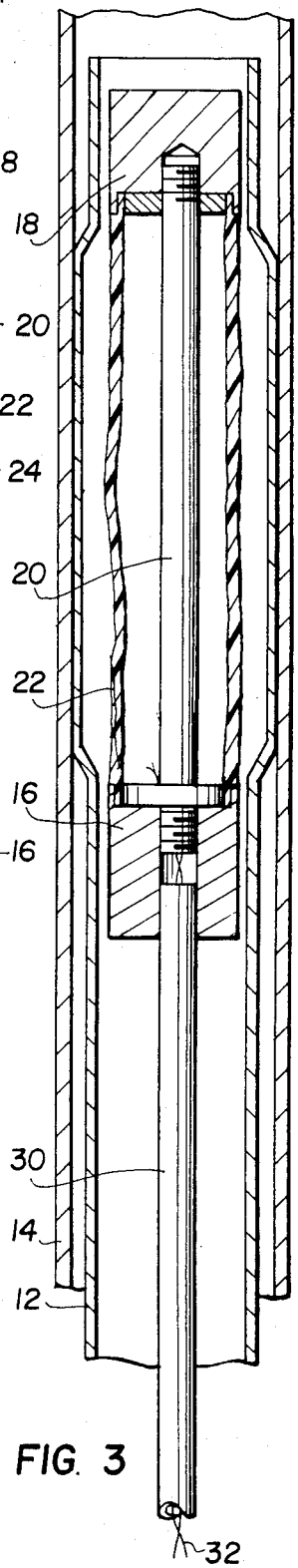
FIG. 3 is a view similar to FIG. 2 showing the apparatus after the propellant has been spent and the expanding gases have been vented for withdrawal of the apparatus from the now expanded tubular member.

Once the propellant is exhausted the gases may be vented, for example through ignition port 26, the bladder 22 collapses as shown in FIG. 3, and the apparatus 10 can then be removed.

The tubular member 12 is thus expanded in the vapor generator tube 14, in a rapid and secure manner, and with a minimum of on site exposure to nuclear radiation.

In comparison with the prior art hydraulic method of expanding tubing, the present invention provides an apparatus and method which can expand a tubular member within 10 to 15 milliseconds, as opposed to a period of about 5 minutes required by the hydraulic technique. This is particularly significant where a large number of vapor generator tubes must be repaired in an environment exposed to nuclear radiation.

Another advantage of the present invention is its cleanliness. While this is not generally a problem for the hydraulic expansion technique, it can be a problem in other expansion techniques which require lubricants or produce undesirable or harmful waste products. The propellant used with the invention is totally contained within the bladder 22 and the generated gases can be vented to a location outside the expansion area. Thus, there is no tube contamination which would pose problems to subsequent brazing and could leave undesirable products within the tube or on the tube surface, possibly leading to future tube degradation.

A further advantage of the present invention over the prior art is that it requires far fewer auxiliaries. In the simplest form, a power supply need not be connected to the ignition wires. Unlike the hydraulic technique, the present invention does not require pumps, water supplies, piping, pressure recorders or electronic controls.

As opposed to roller type expanders, the present invention does not produce a damaged layer of material on the tube surface, thereby eliminating future corrosion problems which can result from such damage.

In addition to repairing nuclear-fueled vapor generators, the present invention can be utilized in any type of heat exchanger and with other types of material. Also the apparatus and method can be used with practically any diameter tubing and can make an expansion of any desired length.

Exemplary materials for the bladder consist of polyurethane or similar substances having the requisite resiliency.

Exemplary materials for the propellant charge are smokeless gunpowders having the requisite burning rate. Smokeless gunpowders usable in accordance with the present invention include the materials sold under the trademarks HI-SKOR and designated as 700-X by E. I. DuPont de Nemours & Co., Inc., and HERCULES 2400 by Hercules Incorporated.

While a specific embodiment of the invention has been shown and described in detail to illustrate the application of the principles of the invention, it will be understood that the invention may be otherwise embodied without departing from such principles.

What is claimed is:

1. An apparatus for radially expanding a tubular member concentrically located within a tube of a nuclear steam generator and having an annular space therebetween, comprising a first end cap, a second end cap spaced from the first end cap, a post rigidly connected between said end caps, means for fixedly connecting the caps relative to each other and the post in a spaced relationship, an expandable bladder connected to and extended between the caps and around the post to define a closed space therewith, a solid propellant contained within the closed space, the bladder being a flexible and resilient material, the end caps being insertable within the tubular member with the first end cap and the second end cap being radially spaced from the tubular member, the bladder being rapidly expandable from a position out of contact with the tubular member into contact with the tubular member responsive to the explosive generation of gas within the closed space upon ignition of the propellant and contractable out of contact with the tubular member responsive to venting of the gas from the closed space, means for igniting the propellant to generate gas and radially expand said bladder and the tubular member to effect contact between the tubular member and the tube, and means for venting the gas.

2. An apparatus according to claim 1, wherein the first cap includes a bore exetnding therethrough, the post being fixed within the bore and having an ignition port connecting the bore with said closed space.

3. An apparatus according to claim 1, wherein the post includes flange means disposed within the closed space adjacent the caps, and said caps having sleeve portions surrounding the flange means, and end portions of the bladder being fixed between said sleeves and flange means.

4. An apparatus according to claim 1, including a positioning rod fixedly engaged to the first cap, the rod having a longitudinal bore therein, the ignition means comprising a pair of wires extending through the longitudinal bore, the post having an ignition port therein connecting the bore of the first cap with the space, the pair of wires continuing through the ignition port to the closed space, and an ignitor connected to said ignition wires.

5. An apparatus according to claim 1, wherein the bladder comprises polyurethane.

6. An apparatus according to claim 5, wherein the propellant is a smokeless gunpowder.

7. An apparatus according to claim 1, wherein the propellant fills the closed space.

8. An apparatus according to claim 1, wherein the propellant partially fills the closed space.

9. A method of radially expanding a tubular member comprising:

locating the tubular member concentrically within a tube of a nuclear steam generator while maintaining an annular space therebetween;

providing an apparatus having spaced end caps rigidly fixed to each other by a post with an expandable bladder connected to and extended between the caps and around the post to define a closed space, the bladder comprising a flexible and resilient material rapidly expandable from a position out of contact with the tubular member into contact with the tubular member responsive to the explosive generation of gas upon ignition of a propellant within the closed space and contractable out of contact with the tubular member responsive to venting of the gas from the closed space;

providing a fast burning solid propellant in the closed space which upon ignition generates large quantities of gas;

positioning the apparatus within the tubular member closely spaced away from the tubular member;

igniting the propellant to expand said bladder into contact with the tubular member and thereby expand at least a portion of said tubular member to effect contact between the tubular member and the tube; and venting the generated gas.

10. A method according to claim 9, wherein the step of providing the fast burning propellant in the closed space comprises filling the closed space with the propellant.

11. A method according to claim 9, wherein the step of providing the fast burning propellant in the closed space comprises partially filling the closed space with the propellant.

* * * * *